US008882109B2

(12) United States Patent
Asada

(10) Patent No.: US 8,882,109 B2
(45) Date of Patent: Nov. 11, 2014

(54) PAPER SHEET PROCESSING APPARATUS

(71) Applicant: Glory Ltd., Himeji (JP)

(72) Inventor: Toshihide Asada, Himeji (JP)

(73) Assignee: Glory Ltd., Himeji-Shi, Hyogo-Ken (JP)

( * ) Notice: Subject to any disclaimer, the term of this patent is extended or adjusted under 35 U.S.C. 154(b) by 0 days.

(21) Appl. No.: 13/912,226

(22) Filed: Jun. 7, 2013

(65) Prior Publication Data

US 2013/0328263 A1 Dec. 12, 2013

(30) Foreign Application Priority Data

Jun. 7, 2012 (JP) ..... 2012-130132

(51) Int. Cl.

| | |
|---|---|
| ***B65H 29/00*** | (2006.01) |
| ***G07D 11/00*** | (2006.01) |
| ***B65H 31/24*** | (2006.01) |
| ***G07D 7/00*** | (2006.01) |
| ***B65H 7/02*** | (2006.01) |

(52) U.S. Cl.

CPC ..... *G07D 7/00* (2013.01); *G07D 11/0045* (2013.01); *B65H 31/24* (2013.01); *B65H 7/02* (2013.01); *G07D 11/0036* (2013.01)

USPC ..... 271/279; 271/298

(58) Field of Classification Search

USPC ..... 271/279, 298, 287, 288, 290

See application file for complete search history.

(56) References Cited

U.S. PATENT DOCUMENTS

| | | | | |
|---|---|---|---|---|
| 2010/0017018 | A1* | 1/2010 | Morino et al. | 700/223 |
| 2010/0225047 | A1* | 9/2010 | Yoshimura et al. | 271/9.07 |
| 2011/0004337 | A1* | 1/2011 | Doi | 700/223 |

FOREIGN PATENT DOCUMENTS

| | | | |
|---|---|---|---|
| EP | 2 249 318 | A1 | 11/2010 |
| EP | 2 357 620 | A1 | 8/2011 |
| EP | 2 413 295 | A1 | 2/2012 |
| WO | WO 2008/096429 | A1 | 8/2008 |

OTHER PUBLICATIONS

European Search Report (Application No. 13170959.4) (7 pages—dated Nov. 29, 2013).

* cited by examiner

*Primary Examiner* — Michael McCullough
*Assistant Examiner* — Howard Sanders
(74) *Attorney, Agent, or Firm* — Renner, Kenner, Greive, Bobak, Taylor & Weber

(57) ABSTRACT

A paper sheet processing apparatus comprises a taking-in unit 10 configured to take therein paper sheets, a transport unit 70 configured to transport the paper sheets, a recognition unit 20 configured to recognize the paper sheets, a plurality of stacking units 60*a* to 60*d* configured to stack the paper sheets, the paper sheets stacked in the stacking units 60*a*-60*d* being able to be removed from the stacking units 60*a*-60*d*, and a detection sensor 25*a* to 25*d* configured to detect whether the paper sheets have been removed from the stacking units 60*a*-60*d*. When a control unit 50 judges that the paper sheets have been removed from the stacking units 60*a* to 60*d* based on information from the detection sensor 25*a* to 25*d*, the control unit 50 outputs removal information on the removed paper sheets or the stacking units 60*a* to 60*d* from which the paper sheets have been removed.

20 Claims, 6 Drawing Sheets

REMOVAL HISTORY

| | | | |
|---|---|---|---|
| 15:01 | STK1 | ATM | 100 |
| 14:55 | STK2 | UNFIT | 100 |
| 14:54 | STK4 | TLR | 100 |
| 14:51 | STK2 | UNFIT | 100 |
| 14:50 | STK4 | TLR | 100 |

30a OR 30b

FIG. 4

REMOVAL HISTORY

| | | | | |
|---|---|---|---|---|
| 15:01 | STK1 | ATM | NEW | 100 |
| 14:55 | STK2 | UNFIT | OLD | 100 |
| 14:54 | STK4 | TLR | NEW | 100 |
| 14:51 | STK2 | UNFIT | NEW | 100 |
| 14:50 | STK4 | TLR | OLD | 100 |

30a OR 30b

FIG. 5

REMOVAL HISTORY — PERSON A IN CHARGE

| | | | |
|---|---|---|---|
| 15:01 | STK1 | ATM | 100 |
| 14:55 | STK2 | UNFIT | 100 |
| 14:54 | STK4 | TLR | 100 |
| 14:51 | STK2 | UNFIT | 100 |
| 14:50 | STK4 | TLR | 100 |

30a

REMOVAL HISTORY — PERSON B IN CHARGE

| | | | |
|---|---|---|---|
| 15:05 | STK8 | UNFIT | 100 |
| 15:01 | STK6 | TLR | 100 |

30b

F I G. 7

REMOVAL HISTORY — PERSON A IN CHARGE

| | | | | |
|---|---|---|---|---|
| 15:01 | STK1 | ATM | NEW | 100 |
| 14:55 | STK2 | UNFIT | OLD | 100 |
| 14:54 | STK4 | TLR | NEW | 100 |
| 14:51 | STK2 | UNFIT | NEW | 100 |
| 14:50 | STK4 | TLR | OLD | 100 |

30a

REMOVAL HISTORY — PERSON B IN CHARGE

| | | | | |
|---|---|---|---|---|
| 15:05 | STK8 | UNFIT | OLD | 100 |
| 15:01 | STK6 | TLR | NEW | 100 |

30b

F I G. 8

PAPER SHEET PROCESSING APPARATUS

CROSS REFERENCE TO RELATED APPLICATION

This application claims the benefit of priority from the prior Japanese Patent Application No. 2012-130132 filed on Jun. 7, 2012, the entire contents of which are incorporated herein by reference.

FIELD OF THE INVENTION

The present invention relates to a paper sheet processing apparatus equipped with a plurality of stacking units from which stacked paper sheets may be removed.

BACKGROUND ART

Hitherto, there is known a paper sheet processing apparatus including a casing, a placing unit which is provided in the casing so as to place paper sheets thereon, a transport unit which transports the paper sheets taken from the placing unit into the casing, and a plurality of stacking units which stack the paper sheets transported by the transport unit according to each sort and from which stacked paper sheets may be removed (for example, see WO 2008/096429 A).

In a case where a large number of paper sheets are continuously processed in such a paper sheet processing apparatus, the stacking process is stopped once at a time point when each stacking unit is fully filled with the paper sheets or a predetermined number of paper sheets are stacked in the stacking units. Then, the paper sheets are removed from the stacking units, and then the process on the paper sheets is resumed. Furthermore, the removed paper sheets are sent to the next process.

In a case where the operation of removing the paper sheets is frequently performed, an operator may forget the sorts of the paper sheets removed from the stacking units. For example, the operator may forget whether the removed paper sheets are fit notes or unfit notes, or new notes or old notes.

SUMMARY OF THE INVENTION

In view of the above-described circumstances, the invention provides a paper sheet processing apparatus capable of helping an operator to recognize sorts of paper sheets removed from stacking units.

A paper sheet processing apparatus in accordance with the present invention comprises:

a taking-in unit configured to take therein paper sheets one by one;

a transport unit configured to transport the paper sheets taken in by the taking-in unit;

a recognition unit configured to recognize the paper sheets transported by the transport unit;

a plurality of stacking units configured to stack the paper sheets transported by the transport unit, the paper sheets stacked in the stacking units being able to be removed from the stacking units 60*a*-60*d;* a control unit configured to transport the paper sheets into the stacking units based on a recognition result of the recognition unit; and a detection sensor configured to detect whether the paper sheets have been removed from the stacking units, wherein when the control unit judges that the paper sheets have been removed from the stacking units based on information from the detection sensor, the control unit outputs removal information on the removed paper sheets or the stacking units from which the paper sheets have been removed.

In the paper sheet processing apparatus in accordance with the present invention, the removal information may include information on sorts of the removed paper sheets.

In the paper sheet processing apparatus in accordance with the present invention, the sorts of the removed paper sheets may be based on fitness or version of the paper sheets.

In the paper sheet processing apparatus in accordance with the present invention, the removal information may include information on the stacking units from which the paper sheets have been removed.

In the paper sheet processing apparatus in accordance with the present invention, the control unit may be configured to appropriately change the sorts of the paper sheets to be stacked in the stacking units and to transport the paper sheets into the respective stacking units.

In the paper sheet processing apparatus in accordance with the present invention, the control unit may be configured to change the sorts of the paper sheets to be stacked in the stacking units based on, at least, the information from the detection sensor.

In the paper sheet processing apparatus in accordance with the present invention, the control unit may be configured to fix the sorts of the paper sheets to be stacked in the stacking units and to transport the paper sheets into the respective stacking units.

In the paper sheet processing apparatus in accordance with the present invention, the removal information may include information on a time at which the paper sheets were removed from the stacking units.

In the paper sheet processing apparatus in accordance with the present invention, the removal information may include information on the number of the paper sheets removed from the stacking units.

The paper sheet processing apparatus in accordance with the present invention may further comprise a main display unit configured to display the removal information.

The paper sheet processing apparatus in accordance with the present invention may further comprise an individual display unit corresponding to each of the stacking units, the individual display unit being configured to display the removal information on the corresponding stacking unit.

In the paper sheet processing apparatus in accordance with the present invention, the plurality of stacking units may be divided into at least two or more groups, and the control unit may be configured to separately output the removal information on each group.

In the paper sheet processing apparatus in accordance with the present invention, the control unit may be configured to output information on a person in charge allocated to each group.

According to the invention, when a control unit judges that paper sheets have been removed from a stacking unit based on information from the detection sensor, the control unit outputs removal information on the removed paper sheets or the stacking unit in which the paper sheets are stacked. For this reason, an operator may recognize the sorts of the paper sheets removed from the stacking unit.

BRIEF DESCRIPTION OF THE DRAWINGS

FIG. 4 is a diagram illustrating an example of a display configuration of a first main display unit or a second main display unit of the paper sheet processing apparatus according to the first embodiment of the invention;

FIG. 5 is a diagram illustrating another example of the display configuration of the first main display unit or the second main display unit of the paper sheet processing apparatus according to the first embodiment of the invention;

FIG. 7 is a diagram illustrating an example of display configurations of a first main display unit and a second main display unit of the paper sheet processing apparatus according to the third embodiment of the invention; and FIG. 8 is a diagram illustrating another example of the display configurations of the first main display unit and the second main display unit of the paper sheet processing apparatus according to the third embodiment of the invention.

DETAILED DESCRIPTION OF THE INVENTION

First Embodiment

<<Configuration>>

Figure 1:
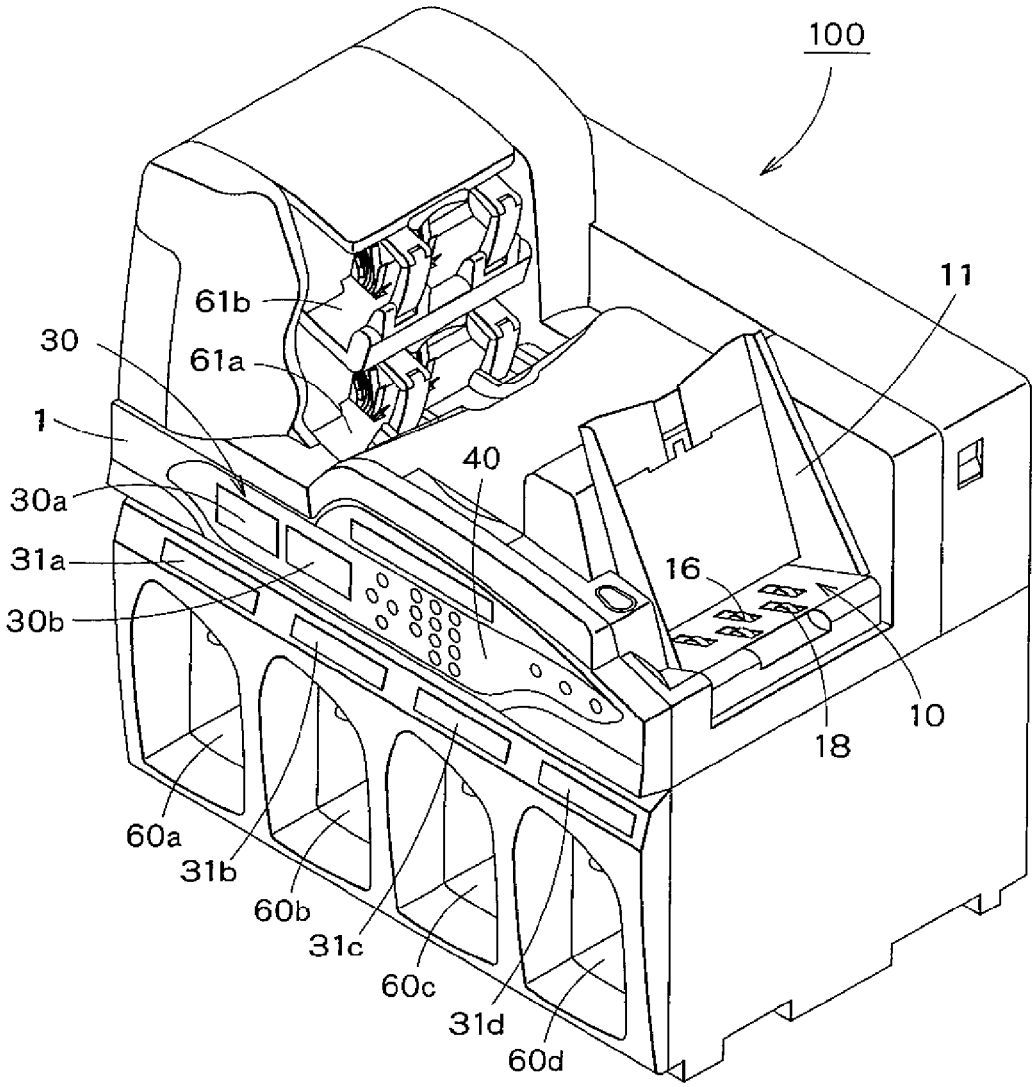
FIG. 1 is a perspective view of a paper sheet processing apparatus according to a first embodiment of the invention.

Hereinafter, a first embodiment of a paper sheet processing apparatus according to the invention will be described by referring to the drawings. Here, FIGS. 1 to 5 are diagrams for illustrating the first embodiment of the invention. Incidentally, the "paper sheet" in the present application indicates a banknote, a check, a coupon, and the like, but typically indicates the banknote.

As illustrated in FIG. 1, a paper sheet processing apparatus 100 of the embodiment includes a casing 1, a placing unit 11 which is provided in the casing 1 so as to place a plurality of paper sheets thereon, a taking-in unit 10 which takes therein the paper sheets placed on the placing unit 11 one by one, a transport unit 70 (see FIG. 2) which transports the respective paper sheets taken in by the taking-in unit 10 into the casing 1, a recognition unit 20 (see FIG. 2) which recognizes the paper sheets transported by the transport unit 70, a plurality of stacking units 60*a* to 60*d* which stack the paper sheets transported by the transport unit 70 and the paper sheets stacked in the stacking units 60*a* to 60*d* being able to be removed from the stacking units 60*a* to 60*d* via openings thereof to outside, and rejecting units 61*a* and 61*b* which reject the paper sheets that are not stacked in the stacking units 60*a* to 60*d*.

Furthermore, in the embodiment, a configuration is described in which the stacking units 60*a* to 60*d* include the first stacking unit 60*a*, the second stacking unit 60*b* provided adjacent to the first stacking unit 60*a*, the third stacking unit 60*c* provided adjacent to the second stacking unit 60*b*, and the fourth stacking unit 60*d* provided adjacent to the third stacking unit 60*c*. However, the invention is not limited thereto as long as a configuration is employed which includes the plurality of stacking units 60*a* to 60*d*. Further, in FIG. 1, a configuration is illustrated in which the front surface sides of the stacking units 60*a* to 60*d* are opened, but a configuration may be employed in which the paper sheets may be removed from the stacking units 60*a* to 60*d*. For example, the front surfaces of the stacking units 60*a* to 60*d* may be provided with doors or covers that may be opened or closed so as to cover the openings thereof. Incidentally, the respective stacking units 60*a* to 60*d* may stack, for example, five hundred paper sheets.

Figure 2:
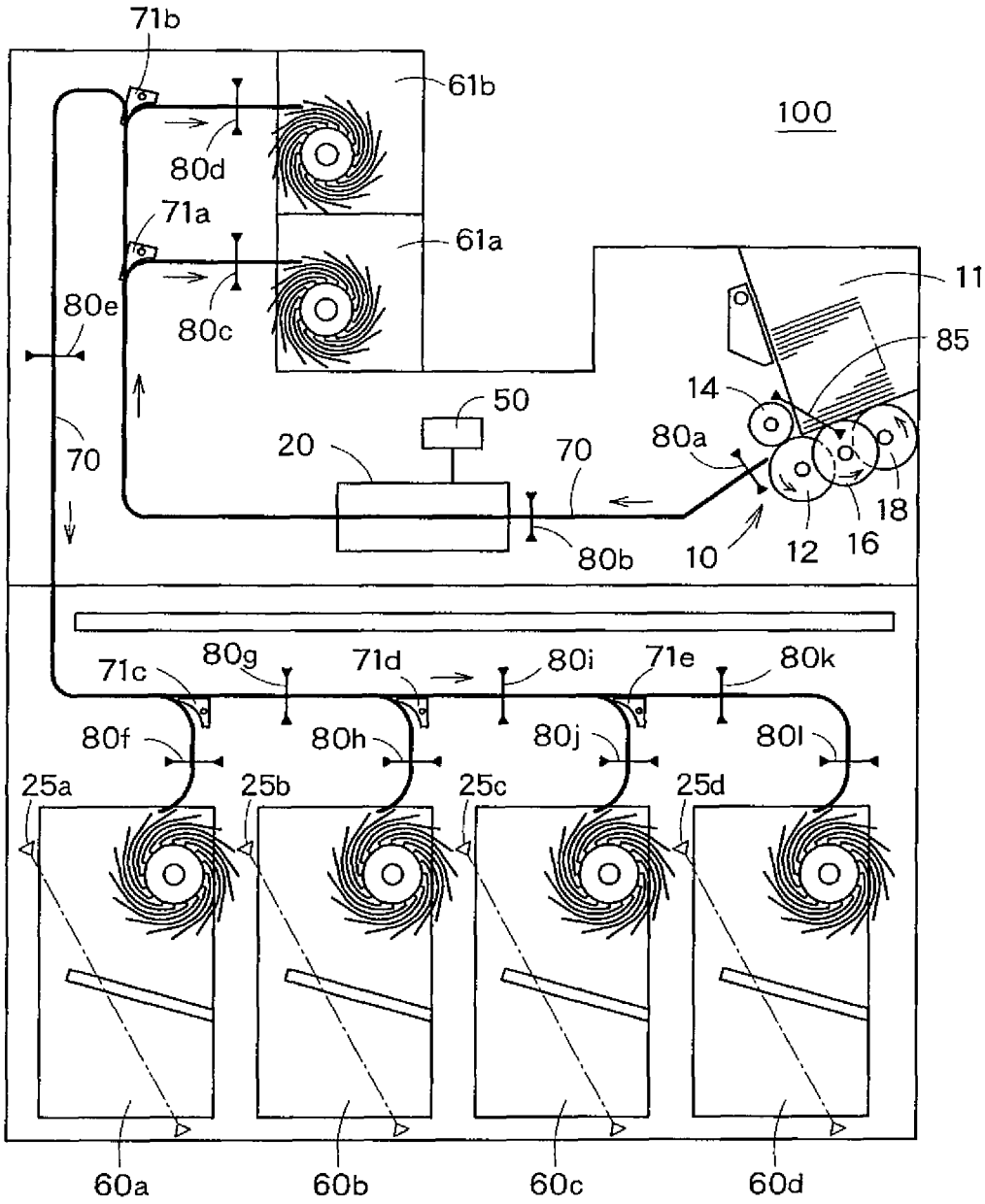
FIG. 2 is a side cross-sectional view illustrating an inner configuration of the paper sheet processing apparatus according to the first embodiment of the invention.
Figure 3:
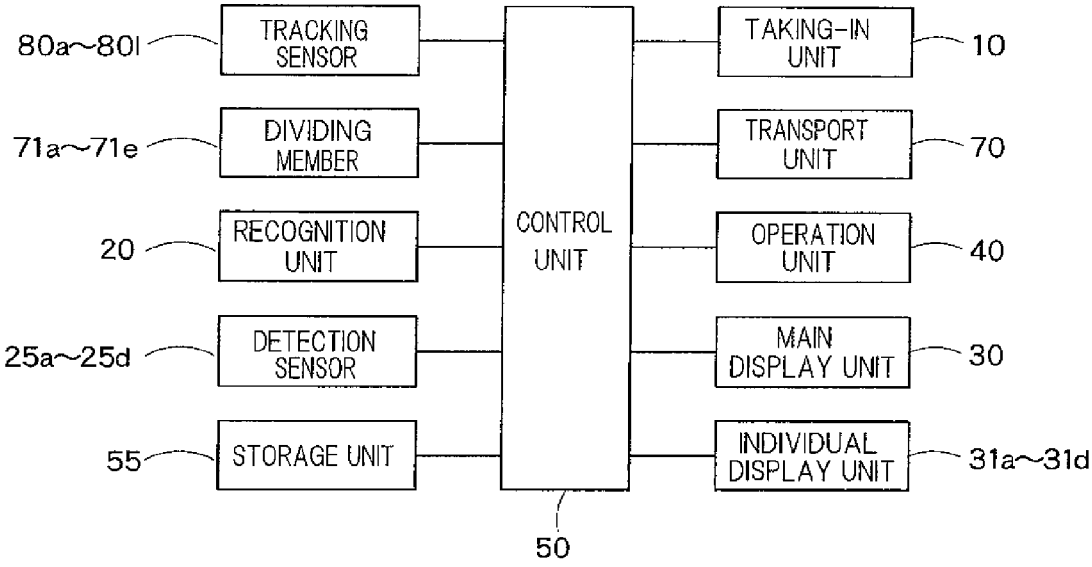
FIG. 3 is a functional block diagram of the paper sheet processing apparatus according to the first embodiment of the invention.

As illustrated in FIG. 2, the paper sheet processing apparatus also includes a control unit 50 which causes the stacking units 60*a* to 60*d* to stack the paper sheets thereon based on the recognition result of the recognition unit 20 and detection sensors 25*a* to 25*d* which detect the paper sheets removed from the stacking units 60*a* to 60*d*. Furthermore, the detection sensors 25*a* to 25*d* are provided so as to respectively correspond to the stacking units 60*a* to 60*d*.

As illustrated in FIG. 2, the taking-in unit 10 includes kicker rollers 16 and 18 which are provided in the placing unit 11 so as to apply a driving force to the paper sheet positioned at the lowermost side and gate mechanisms 12 and 14 which nip the paper sheet applied with the driving force by the kicker rollers 16 and 18 so as to feed the paper sheet into the casing 1. The gate mechanisms 12 and 14 include a feed roller 12 and a gate roller 14 which is provided so as to face the feed roller 12.

Further, the placing unit 11 is provided with a presence/absence sensor 85 which detects the placement of the paper sheet. The transport unit 70 is provided with a plurality of tracking sensors 80*a* to 801 which detect the track of the paper sheet.

Further, the transport unit 70 is provided with a plurality of dividing members 71*a* to 71*e* which appropriately divide the paper sheets transported by the transport unit 70.

Further, as illustrated in FIG. 1, the casing 1 is provided with an operation unit 40 to which an operator may input predetermined information.

When the control unit 50 of the embodiment judges that the paper sheets have been removed from the stacking units 60*a* to 60*d* based on information from the detection sensor 25*a* to 25*d*, removal information on the removed paper sheets or the stacking units 60*a* to 60*d* in which the removed paper sheets were stacked is output to an output unit. The removal information on the removed paper sheets indicates, for example, information on the sorts of the paper sheets such as fitness and version of the paper sheets, information on the number of the paper sheets removed from the stacking units 60*a* to 60*d*, or the like. The removal information on the stacking units 60*a* to 60*d* in which the removed paper sheets were stacked indicates, for example, information representing the stacking unit from which the paper sheets have been removed among the stacking units 60*a* to 60*d*, information on the time at which the paper sheets were removed from the stacking units 60*a* to 60*d*, or the like. In a case where the removal information is output as an image display, the output unit may be configured as a main display unit 30 or individual display units 31*a* to 31*d* to be described later.

Furthermore, the above-described removal information is stored in a storage unit 55 (see FIG. 3) which is connected to the control unit 50.

As illustrated in FIG. 1, the casing 1 is provided with the main display unit 30 which is configured by, for example, an LCD (Liquid Crystal Display) as the output unit that displays the removal information thereon. The main display unit 30 of the embodiment includes a first main display unit 30*a* and a second main display unit 30*b* which is provided adjacent to the first main display unit 30*a*. Both the first main display unit 30*a* and the second main display unit 30*b* are configured by LCDs.

The main display unit 30 of the embodiment displays both the removal information on the removed paper sheets and the removal information on the stacking units 60*a* to 60*d* in which the paper sheets were stacked. As an example, the main display unit 30 displays a removal time, a removal place, fitness information, the number of sheets, and the like in time series (see FIG. 4). Furthermore, the information may be displayed only on the first main display unit 30*a*, may be displayed only on the second main display unit 30*b*, or may be displayed on both the first main display unit 30*a* and the second main display unit 30*b*.

FIG. 4 illustrates a configuration in which the removal time, the removal place, the fitness information, and the number of sheets are sequentially displayed on the first main display unit 30*a* or the second main display unit 30*b* in time series from the left side.

Incidentally, in FIG. 4, "STK" indicates the stacking units (stackers) 60*a* to 60*d*, "STK1" indicates the first stacking unit 60*a*, "STK2" indicates the second stacking unit 60*b*, "STK3" indicates the third stacking unit 60*c*, and "STK4" indicates the fourth stacking unit 60*d*. Furthermore, in a configuration illustrated in FIG. 4, it is assumed that the paper sheet is a banknote. In FIG. 4, "ATM" indicates a banknote which may be used as a banknote to be dispensed by an ATM provided in a financial organization such as a bank, "TLR" indicates a banknote which may not be used in the ATM, but may be used as a banknote to be dispensed by a clerk of the financial organization such as a bank, and "UNFIT" indicates a banknote which may not be used as a banknote to be dispensed by not only the ATM but also the clerk of the financial organization such as a bank.

Furthermore, the banknote which may be used as a banknote to be dispensed by the ATM and the banknote which may not be used in the ATM, but may be used as a banknote to be dispensed by the clerk of the financial organization such as a bank are so-called "fit notes", and the banknote which may not be used a banknote to be dispensed by not only the ATM but also the clerk of the financial organization such as a bank is a so-called "unfit note". That is, in the embodiment, the fitness information is judged and displayed as three levels.

Further, as illustrated in FIG. 1, the casing 1 is provided with the individual display units 31*a* to 31*d*, which are configured by, for example, LEDs (Light Emitting Diodes), at the positions respectively corresponding to the stacking units 60*a* to 60*d*. Then, the individual display units 31*a* to 31*d* display the removal information corresponding to the stacking units 60*a* to 60*d*. That is, the first individual display unit 31*a* corresponds to the first stacking unit 60*a*, and the first individual display unit 31*a* displays the removal information on the first stacking unit 60*a*. Similarly, the second individual display unit 31*b* corresponds to the second stacking unit 60*b*, the second individual display unit 31*b* displays the removal information on the second stacking unit 60*b*, the third individual display unit 31*c* corresponds to the third stacking unit 60*c*, the third individual display unit 31*c* displays the removal information on the third stacking unit 60*c*, the fourth individual display unit 31*d* corresponds to the fourth stacking unit 60*d*, and the fourth individual display unit 31*d* displays the removal information on the fourth stacking unit 60*d*.

When the paper sheets have been removed from the corresponding stacking units 60*a* to 60*d*, the individual display units 31*a* to 31*d* notify the stacking units 60*a* to 60*d* from which the paper sheets have been removed to an operator in a manner such that the display units display " . . . " (dot) for a predetermined time or the display units are turned on with a color different from the color in a normal state. Furthermore, when the paper sheets are counted, the individual display units 31*a* to 31*d* display the counted number of the paper sheets. Then, during the period in which the counting of the paper sheets ends and the removal of the paper sheets is awaited, the individual display units may display the counted number of sheets in a flickering state.

Incidentally, in the embodiment, a configuration is described in which the removal information is displayed on both the main display unit 30 and the individual display units 31*a* to 31*d*, but the invention is not limited thereto. For example, the removal information may be displayed only on the main display unit 30 or the removal information may be displayed only on the individual display units 31*a* to 31*d*. Further, the removal information may be displayed on an external device such as a PC connected to the paper sheet processing apparatus 100, and the removal information may not be displayed in the paper sheet processing apparatus 100.

Incidentally, the control unit 50 of the embodiment appropriately changes the sorts of the paper sheets to be stacked in the stacking units 60*a* to 60*d*, and causes the respective stacking units 60*a* to 60*d* to stack the paper sheets thereon. Further, the control unit 50 changes the sorts of the paper sheets to be stacked in the stacking units 60*a* to 60*d* based on the information from the detection sensors 25*a* to 25*d*. For example, when the control unit 50 judges that the paper sheets have been removed from the stacking units 60*a* to 60*d* based on the information from the detection sensor 25*a* to 25*d*, the sorts of the paper sheets to be stacked in the stacking units 60*a* to 60*d* are changed to the sorts of the paper sheets which are read first at the next time (Furthermore, when the sorts of the paper sheets to be stacked in the stacking units 60*a* to 60*d* are the same as the sorts of the paper sheets read first at the next time, the sorts of the paper sheets to be stacked in the stacking units 60*a* to 60*d* are not changed).

<<Operation and Effect>>

Next, an operation and an effect according to the embodiment with the above-described configuration will be described.

According to the embodiment, when the control unit 50 judges that the paper sheets have been removed from the stacking units 60*a* to 60*d* based on the information from the detection sensor 25*a* to 25*d*, the control unit 50 outputs the removal information on the removed paper sheets or the stacking units 60*a* to 60*d* in which the paper sheets were stacked. Then, the removal information is displayed on the main display unit 30 and the individual display units 31*a* to 31*d*. For this reason, the operator may reliably recognize the sorts of the paper sheets removed from the stacking units 60*a* to 60*d*.

That is, in a case where a large number of paper sheets are continuously processed in the paper sheet processing apparatus of the related art, the stacking process is stopped once at a time point when the respective stacking units 60*a* to 60*d* are fully filled with the paper sheets or a predetermined number of sheets are stacked in the stacking units. Then, the paper sheets are removed from the stacking units 60*a* to 60*d*, and the process on the paper sheets is resumed (Furthermore, the removed paper sheets are wound by a rubber band or the like so as to be stored according to the sorts of the paper sheets). In a case where the operation of removing the paper sheets is frequently performed, the operator may forget the sorts of the paper sheets removed from the stacking units 60*a* to 60*d*. For example, the operator may forget whether the removed paper sheets are fit notes or unfit notes, or new notes or old notes. As a result, the paper sheets may be stored at wrong places.

On the contrary, according to the embodiment, the removal information is output and the operator may check the removal information. Accordingly, even when an operation of removing the paper sheets is frequently performed, the operator may recognize the sorts of the paper sheets removed from the stacking units 60*a* to 60*d*. For this reason, the paper sheets may be accurately stored according to each sort.

Furthermore, in a configuration in which the fitness of the paper sheet is output as the removal information, the operator may sort the paper sheets according to the fitness based on the output information. Furthermore, in a case where the paper sheet is a banknote, the "fitness sorting" indicates the sorting of the banknote which may be used in the ATM, the banknote which may not be used in the ATM, but may be used in the clerk of the financial organization such as a bank, and the banknote which may not be used in not only in the ATM but also the clerk of the financial organization such as a bank.

Further, in a configuration in which the version of the paper sheet is output as the removal information, the operator may sort the paper sheets according to the version based on the output information. Furthermore, in a case where the paper sheet is a banknote, the "version sorting" indicates the sorting of the banknote as a new note and the banknote as an old note.

Incidentally, in a configuration in which the removal information includes information on the sorts of the removed paper sheets, the operator may check the sorts of the removed paper sheets through, for example, the main display unit 30, and hence the operator may reliably recognize the sorts of the paper sheets in his or her hand. For this reason, the operator may reliably and accurately store the paper sheets according to each sort.

Further, in a configuration in which the removal information includes information on the stacking units 60*a* to 60*d* from which the paper sheets have been removed, the operator may check the stacking unit from which the paper sheets have been removed among the stacking units 60*a* to 60*d* by, for example, the main display unit 30 or the individual display units 31*a* to 31*d*. For this reason, the operator may reliably recognize the stacking unit from which the paper sheets in his or her hand have been removed among the stacking units 60*a* to 60*d*. Even when the operator forgets the sorts of the paper sheets, the operator may easily remember the sorts of the paper sheets. Incidentally, according to a configuration in which the stacking units 60*a* to 60*d* and the sorts of the paper sheets are correlated with one another and the sorts of the paper sheets stacked in the stacking units 60*a* to 60*d* are displayed, the operator may reliably recognize the sorts of the paper sheets in his or her hand. For this reason, it is preferable in that the operator may reliably and accurately store the paper sheets according to each sort.

Further, in a configuration in which the removal information includes information on the time at which the paper sheets were removed from the stacking units 60*a* to 60*d*, the operator may check the time at which the paper sheets were removed from the stacking units 60*a* to 60*d* by, for example, the main display unit 30. For this reason, the operator may reliably recognize the time at which the paper sheets in his or her hand were removed from the stacking units 60*a* to 60*d*. Even when the operator forgets the sorts of the paper sheets, the operator may easily remember the sorts of the paper sheets. Incidentally, according to a configuration in which the time at which the paper sheets were removed from the stacking units 60*a* to 60*d* and the sorts of the paper sheets are correlated with one another and the sorts of the paper sheets are displayed in addition to the time at which the paper sheets were removed from the stacking units 60*a* to 60*d*, the operator may reliably recognize the sorts of the paper sheets in his or her hand. For this reason, it is preferable in that the operator may further reliably and accurately store the paper sheets according to each sort.

Further, in a configuration in which the removal information includes information on the number of the paper sheets removed from the stacking units 60*a* to 60*d*, the operator may check the number of the paper sheets removed from the stacking units 60*a* to 60*d* by, for example, the main display unit 30.

Incidentally, according to a configuration illustrated in FIG. 4, the removal time (the first row from the left side), the removal place (the second row from the left side), the fitness information (the third row from the left side), and the number of sheets (the fourth row from the left side) are respectively displayed on the first main display unit 30*a* or the second main display unit 30*b*.

For this reason, the operator may check the removal time and how many paper sheets have been removed from which unit among the stacking units 60*a* to 60*d* and further may check the result of the fitness sorting of the paper sheets by the first main display unit 30*a* or the second main display unit 30*b*. For this reason, the operator may reliably and accurately store the paper sheets in his or her hand according to each sort.

Furthermore, as illustrated in FIG. 5, the first main display unit 30*a* or the second main display unit 30*b* may display the version information of the paper sheets (at the fourth row from the left side) in addition to the removal time, the removal place, the fitness information, and the number of sheets. In such a case, the operator may also reliably sort the paper sheets according to the version information. Further, in a case where the paper sheets are sorted according to only the version information, a configuration may be employed in which the version information of the paper sheets is displayed instead of the fitness information of FIG. 4.

Further, in the embodiment, in addition to the display on the main display unit 30, the individual display units 31*a* to 31*d* notify the stacking units 60*a* to 60*d* from which the paper sheets have been removed to the operator in a manner such that the display units display " . . . " for a predetermined time or the display units are turned on with a color different from the color in a normal state in a case where the paper sheets have been removed from the corresponding stacking units 60*a* to 60*d*. For this reason, the operator may check the stacking unit from which the paper sheets have been removed among the stacking units 60*a* to 60*d* in one glance, and hence the working efficiency may be improved. Incidentally, according to a configuration in which the stacking units 60*a* to 60*d* and the sorts of the paper sheets are correlated with one another and the sorts of the paper sheets stacked in the stacking units 60*a* to 60*d* are displayed on the main display unit 30, it is preferable in that the operator may reliably recognize the sorts of the paper sheets in his or her hand.

Further, in the embodiment, the sorts of the paper sheets to be stacked in the stacking units 60*a* to 60*d* may be appropriately changed and the paper sheets may be stacked in the respective stacking units 60*a* to 60*d*. For this reason, the sorts of the paper sheets to be stacked in the stacking units 60*a* to 60*d* may be flexibly changed in accordance with the situation.

Further, in the embodiment, information is received from the detection sensors 25*a* to 25*d* for detecting the removal of the paper sheets from the stacking units 60*a* to 60*d*, and the sorts of the paper sheets to be stacked in the stacking units 60*a* to 60*d* are changed. For this reason, when the paper sheets have been removed from the stacking units 60*a* to 60*d*, the sorts of the paper sheets may be automatically and appropriately changed, and hence the usage efficiency of the stacking units 60*a* to 60*d* may be improved.

Second Embodiment

Next, a second embodiment of the invention will be described.

In the first embodiment, a configuration is described in which the control unit 50 appropriately changes the sorts of the paper sheets to be stacked in the stacking units 60*a* to 60*d* and causes the respective stacking units 60*a* to 60*d* to stack the paper sheets thereon. However, in the second embodiment, the control unit 50 fixes the sorts of the paper sheets to be stacked in the stacking units 60*a* to 60*d*, and causes the respective stacking units 60*a* to 60*d* to stack the paper sheets thereon.

In the second embodiment, the other configurations are substantially the same as those of the first embodiment. In the second embodiment, the same reference numerals are given to the same components as those of the first embodiment, and the detailed description thereof will not be repeated here.

In the embodiment, the same effect as that of the first embodiment may also be obtained. Since the effect is specifically described in the first embodiment, particularly important points will be described in the description of the effect of the embodiment.

In the embodiment, when the control unit 50 judges that the paper sheets have been removed from the stacking units 60*a* to 60*d* based on the information from the detection sensor 25*a* to 25*d*, the control unit 50 outputs the removal information on the removed paper sheets or the stacking units 60*a* to 60*d* in which the paper sheets were stacked, and the removal information is displayed on the main display unit 30 and the individual display units 31*a* to 31*d*. For this reason, the operator may reliably recognize the sorts (for example, the fitness sorts or the version) of the paper sheets removed from the stacking units 60*a* to 60*d*.

Particularly, in a configuration in which the removal information includes information on the sorts of the removed paper sheets, the operator may check the sorts of the removed paper sheets by, for example, the main display unit 30, and hence the operator may reliably recognize the sorts of the paper sheets in his or her hand. For this reason, the paper sheets may be accurately and reliably stored according to each sort.

Further, in a configuration in which the removal information includes information on the stacking units 60*a* to 60*d* from which the paper sheets have been removed, the operator may check the stacking unit from which the paper sheets have been removed among the stacking units 60*a* to 60*d* by, for example, the main display unit 30 or the individual display units 31*a* to 31*d*. In the embodiment, since the sorts of the paper sheets to be stacked in the stacking units 60*a* to 60*d* are fixed, if the operator may recognize the stacking unit from which the paper sheets have been removed among the stacking units 60*a* to 60*d*, the operator may reliably recognize the sorts of the paper sheets in his or her hand, and hence may accurately and reliably store the paper sheets according to each sort. Incidentally, according to a configuration in which the sorts of the paper sheets stacked in the stacking units 60*a* to 60*d* are displayed, it is preferable in that the operator may further reliably recognize the sorts of the paper sheets in his or her hand.

Further, in a configuration in which the removal information includes information on the time at which the paper sheets were removed from the stacking units 60*a* to 60*d*, the operator may check the time at which the paper sheets were removed from the stacking units 60*a* to 60*d* by, for example, the main display unit 30. For this reason, the operator may reliably recognize the time at which the paper sheets in his or her hand were removed from the stacking units 60*a* to 60*d*. Even when the operator forgets the sorts of the paper sheets, the operator may easily remember the sorts of the paper sheets. Incidentally, according to a configuration in which the time at which the paper sheets were removed from the stacking units 60*a* to 60*d* and the sorts of the paper sheets are correlated with one another and the sorts of the paper sheets are displayed in addition to the time at which the paper sheets were removed from the stacking units 60*a* to 60*d*, it is preferable in that the operator may reliably recognize the sorts of the paper sheets in his or her hand.

Further, in a configuration in which the removal information includes information on the number of the paper sheets removed from the stacking units 60*a* to 60*d*, the operator may check the number of the paper sheets removed from the stacking units 60*a* to 60*d* by, for example, the main display unit 30.

Further, in the embodiment, the individual display units 31*a* to 31*d* notify the stacking units 60*a* to 60*d* from which the paper sheets have been removed to the operator in a manner such that the individual display units display " . . . " for a predetermined time or turned on with a color different from the color in a normal state in a case where the paper sheets have been removed from the corresponding stacking units 60*a* to 60*d*. In the embodiment, since the sorts of the paper sheets to be stacked in the stacking units 60*a* to 60*d* are fixed, if the operator may recognize the stacking unit from which the paper sheets have been removed among the stacking units 60*a* to 60*d* in this way, the operator may reliably recognize the sorts of the paper sheets in his or her hand. Furthermore, the operator may check the stacking unit from which the paper sheets have been removed among the stacking units 60*a* to 60*d* in one glance by such a display on the individual display units 31*a* to 31*d*, and hence the working efficiency may be improved.

Third Embodiment

Figure 6:
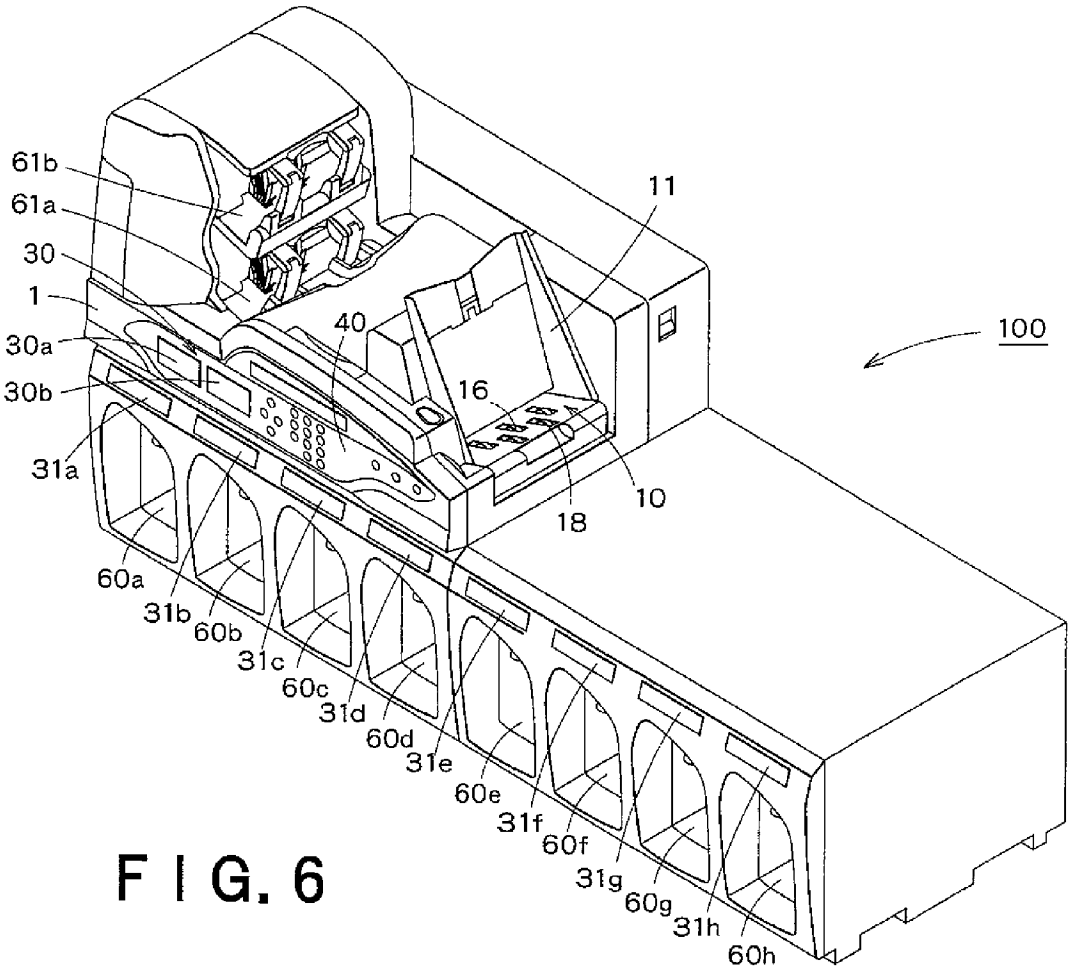
FIG. 6 is a perspective view of a paper sheet processing apparatus according to a third embodiment of the invention.

Next, a third embodiment of the invention will be described by referring to FIGS. 6, 7, and 8.

In the first embodiment, a configuration is illustrated in which four stacking units 60*a* to 60*d* are provided. However, in the embodiment, a configuration is illustrated in which eight stacking units 60*a* to 60*h* are provided. Furthermore, a number of stacking units 60*a* to 60*d* are optional as described above. However, for convenience of description, a configuration with four stacking units 60*a* to 60*d* is used in the first embodiment, and a configuration with eight stacking units 60*a* to 60*h* is used in the third embodiment.

In the embodiment, eight stacking units 60*a* to 60*h* are divided into two groups, and the control unit 50 separately outputs the removal information on each group and outputs information on a person in charge allocated to each group. More specifically, eight stacking units 60*a* to 60*h* of the embodiment are divided into two groups as the group of four stacking units 60*a* to 60*d* from the left side of FIG. 6 and the group of four stacking units 60*e* to 60*h* from the right side of FIG. 6. Then, the control unit 50 separately outputs the removal information on four stacking units 60*a* to 60*d* from the left side and the removal information on four stacking units 60*e* to 60*h* from the right side, and outputs information on a person A in charge of four stacking units 60*a* to 60*d* from the left side and a person B in charge of four stacking units 60*e* to 60*h* from the right side. Furthermore, eight stacking units 60*a* to 60*h* are respectively provided with the corresponding individual display units 31*a* to 31*h*.

Furthermore, in the embodiment, a configuration is illustrated in which the stacking units are divided into two groups, but the invention is not limited thereto. For example, a configuration may be employed in which three or more stacking units are divided into three or more groups.

Further, in a configuration illustrated in FIG. 4 of the first embodiment, the first main display unit 30*a* or the second main display unit 30*b* displays each of the removal time, the removal place, the fitness information, and the number of sheets. Further, in a configuration illustrated in FIG. 5 of the first embodiment, the first main display unit 30*a* or the second main display unit 30*b* displays each of the removal time, the removal place, the fitness information, the version information, and the number of sheets.

On the contrary, in a configuration illustrated in FIG. 7 of the third embodiment, the first main display unit 30*a* displays the notice for the person A in charge ("person A in charge" of FIG. 7) and each of the removal time, the removal place, the fitness information, and the number of sheets with respect to the person A in charge. Further, the second main display unit 30*b* displays the notice for the person B in charge ("person B in charge" of FIG. 7) and each of the removal time, the removal place, the fitness information, and the number of sheets with respect to the person B in charge.

Further, in a configuration illustrated in FIG. 8 of the third embodiment, the first main display unit 30*a* displays the notice for the person A in charge ("person A in charge" of FIG. 8) and each of the removal time, the removal place, the fitness information, the version information, and the number of sheets with respect to the person A in charge. Further, the second main display unit 30*b* displays the notice for the person B in charge ("person B in charge" of FIG. 8) and each of the removal time, the removal place, the fitness information, the version information, and the number of sheets with respect to the person B in charge.

Incidentally, in the description above, a configuration is described in which the first main display unit 30*a* displays the removal information with respect to the person A in charge and the second main display unit 30*b* displays the removal information with respect to the person B in charge, but the invention is not limited thereto. For example, a configuration may be employed in which the removal information with respect to the person A in charge and the person B in charge is displayed only on the first main display unit 30*a* or the removal information with respect to the person A in charge and the person B in charge is displayed only on the second main display unit 30*b*. Further, a configuration may be employed in which the removal information is displayed on an external device such as PC connected to the paper sheet processing apparatus 100 and the removal information is not displayed on the paper sheet processing apparatus 100.

In the third embodiment, the other configurations are substantially the same as those of the first embodiment. In the third embodiment, the same reference numerals are given to the same components as those of the first embodiment, and the detailed description thereof is not be repeated here.

According to the embodiment, the control unit 50 outputs the removal information with respect to four stacking units 60*a* to 60*d* from the left side so that the removal information is displayed on the first main display unit 30*a*, and the control unit 50 outputs the removal information with respect to four stacking units 60*e* to 60*h* from the right side so that the removal information is displayed on the second main display unit 30*b*. For this reason, even when two operators sort the paper sheets by using one paper sheet processing apparatus 100, the respective operators may accurately recognize the removal information with respect to the paper sheets removed from the stacking units 60*a* to 60*h* by himself or herself.

Particularly, in the embodiment, since the first main display unit 30*a* displays the notice for the person A in charge ("person A in charge" of FIG. 6) and the second main display unit 30*b* displays the notice for the person B in charge ("person B in charge" of FIG. 6), the respective persons in charge may reliably recognize the removal information with respect to the paper sheets removed from the stacking units 60*a* to 60*h* by himself or herself.

Incidentally, a configuration of the third embodiment may be used in the second embodiment. That is, the control unit 50 of the third embodiment may cause the respective stacking units 60*a* to 60*d* to stack the paper sheets thereon by appropriately changing the sorts of the paper sheets to be stacked in the stacking units 60*a* to 60*d* as in the first embodiment, and may also cause the respective stacking units 60*a* to 60*d* to stack the paper sheets thereon by fixing the sorts of the paper sheets to be stacked in the stacking units 60*a* to 60*d* as in the second embodiment.

Furthermore, in the embodiment, the same effects as those of the first embodiment and the second embodiment may be obtained in addition to the above-described effect. However, in the embodiment, the description of these effects will not be made so as to avoid the repetitive description thereof.

Incidentally, the description of the embodiments above and the disclosure of the drawings are merely examples for describing the invention disclosed in claims, and the invention disclosed in claims is not limited to the description of the embodiment above or the disclosure of the drawings.

1 casing
10 taking-in unit
20 recognition unit
25*a* to 25*d* detection sensor
30 main display unit
30*a* first main display unit
30*b* second main display unit
31*a* to 31*h* individual display unit
50 control unit
60*a* to 60*h* stacking unit
70 transport unit
100 paper sheet processing apparatus

What is claimed is:

1. A paper sheet processing apparatus comprising:

a taking-in unit configured to take therein paper sheets one by one;

a transport unit configured to transport the paper sheets taken in by the taking-in unit;

a recognition unit configured to recognize the paper sheets transported by the transport unit;

a plurality of stacking units configured to stack the paper sheets transported by the transport unit, the paper sheets stacked in the stacking units being able to be removed from the stacking units;

a control unit configured to sort and transport the paper sheets into the stacking units based on a recognition result of the recognition unit; and a detection sensor configured to detect whether the paper sheets have been removed from the stacking units, wherein when the control unit judges that the paper sheets have been removed from the stacking units based on information from the detection sensor, the control unit outputs removal information on the removed paper sheets, and wherein the removal information includes information on sorts of the paper sheets.

2. The paper sheet processing apparatus according to claim 1, wherein the sorts of the removed paper sheets are based on fitness or version of the paper sheets.

3. The paper sheet processing apparatus according to claim 1, wherein the control unit is configured to appropriately change the sorts of the paper sheets to be stacked in the stacking units and to transport the paper sheets into the respective stacking units.

4. The paper sheet processing apparatus according to claim 3, wherein the control unit is configured to change the sorts of the paper sheets to be stacked in the stacking units based on, at least, the information from the detection sensor.

5. The paper sheet processing apparatus according to claim 1, wherein the removal information includes information on the number of the paper sheets removed from the stacking units.

6. The paper sheet processing apparatus according to claim 1, further comprising a main display unit configured to display the removal information.

7. The paper sheet processing apparatus according to claim 1, further comprising an individual display unit corresponding to each of the stacking units, the individual display unit being configured to display the removal information on the corresponding stacking unit.

8. The paper sheet processing apparatus according to claim 1, wherein the control unit outputs the removal information in time series.

9. A paper sheet processing apparatus, comprising:

a taking-in unit configured to take therein paper sheets one by one;

a transport unit configured to transport the paper sheets taken in by the taking-in unit;

a recognition unit configured to recognize the paper sheets transported by the transport unit;

a plurality of stacking units configured to stack the paper sheets transported by the transport unit, the paper sheets stacked in the stacking units being able to be removed from the stacking units;

a control unit configured to transport the paper sheets into the stacking units based on a recognition result of the recognition unit; and a detection sensor configured to detect whether the paper sheets have been removed from the stacking units, wherein when the control unit judges that the paper sheets have been removed from the stacking units based on information from the detection sensor, the control unit outputs removal information on the removed paper sheets or the stacking units from which the paper sheets have been removed, and wherein the removal information includes information on a time at which the paper sheets were removed from the stacking units.

10. The paper sheet processing apparatus according to claim 9, further comprising a main display unit configured to display the removal information.

11. The paper sheet processing apparatus according to claim 9, further comprising an individual display unit corresponding to each of the stacking units, the individual display unit being configured to display the removal information on the corresponding stacking unit.

12. A paper sheet processing apparatus, comprising:

a taking-in unit configured to take therein paper sheets one by one;

a transport unit configured to transport the paper sheets taken in by the taking-in unit;

a recognition unit configured to recognize the paper sheets transported by the transport unit;

a plurality of stacking units configured to stack the paper sheets transported by the transport unit, the paper sheets stacked in the stacking units being able to be removed from the stacking units;

a control unit configured to transport the paper sheets into the stacking units based on a recognition result of the recognition unit; and a detection sensor configured to detect whether the paper sheets have been removed from the stacking units, wherein when the control unit judges that the paper sheets have been removed from the stacking units based on information from the detection sensor, the control unit outputs removal information on the removed paper sheets or the stacking units from which the paper sheets have been removed, and wherein the control unit is configured to output information on a person in charge allocated to each group.

13. The paper sheet processing apparatus according to claim 12, wherein the control unit outputs the removal information in time series.

14. The paper sheet processing apparatus according to claim 12, further comprising a main display unit configured to display the removal information.

15. The paper sheet processing apparatus according to claim 12, further comprising an individual display unit corresponding to each of the stacking units, the individual display unit being configured to display the removal information on the corresponding stacking unit.

16. A paper sheet processing apparatus comprising:

a taking-in unit configured to take therein paper sheets one by one;

a transport unit configured to transport the paper sheets taken in by the taking-in unit;

a recognition unit configured to recognize the paper sheets transported by the transport unit;

a plurality of stacking units configured to stack the paper sheets transported by the transport unit, the paper sheets stacked in the stacking units being able to be removed from the stacking units;

a control unit configured to transport the paper sheets into the stacking units based on a recognition result of the recognition unit; and a detection sensor configured to detect whether the paper sheets have been removed from the stacking units, wherein when the control unit judges that the paper sheets have been removed from the stacking units based on information from the detection sensor, the control unit outputs removal information on the stacking units, and wherein the removal information includes information on the stacking units from which the paper sheets have been removed.

17. The paper sheet processing apparatus according to claim 16, wherein the removal information includes information on the number of the paper sheets removed from the stacking units.

18. The paper sheet processing apparatus according to claim 16, wherein the control unit outputs the removal information in time series.

19. The paper sheet processing apparatus according to claim 16, further comprising a main display unit configured to display the removal information.

20. The paper sheet processing apparatus according to claim 16, further comprising an individual display unit corresponding to each of the stacking units, the individual display unit being configured to display the removal information on the corresponding stacking unit.

* * * * *